US005545036A

United States Patent [19]

Kwiatek

[11] Patent Number: 5,545,036

[45] Date of Patent: Aug. 13, 1996

[54] GASEOUS FUEL BURNER AND METHOD OF MAKING SAME

[75] Inventor: David J. Kwiatek, LaGrange, Ill.

[73] Assignee: Eaton Corporation, Cleveland, Ohio

[21] Appl. No.: 439,237

[22] Filed: May 11, 1995

Related U.S. Application Data

[62] Division of Ser. No. 282,359, Jul. 29, 1994, Pat. No. 5,464,345.

[51] Int. Cl.[6] ..... F23Q 3/00

[52] U.S. Cl. ..... 431/266; 126/39 R; 126/39 E

[58] Field of Search ..... 431/264, 265, 431/266, 263, 258; 123/169 EL, 297; 126/39 R, 39 BA, 39 E

[56] References Cited

U.S. PATENT DOCUMENTS 4,343,272 8/1982 Buck ..... 123/169 EL 5,002,038 3/1991 Riehl ..... 431/266

*Primary Examiner*—James C. Yeung

*Attorney, Agent, or Firm*—Roger A. Johnston

[57] ABSTRACT

An integrally formed metal burner ring has a coil spring with a reduced center coil inserted in the burner inlet. Upon insertion of a fuel supply tube into the coil spring the center coil frictionally engages and seals over the supply tube and the spring is expanded to engage and seal against the burner inlet. An ignitor with a hollow tubular refractory holder has a hollow tubular electrode disposed in the hollow of the holder. The holder has a flat end face as an arc discharge surface with the end of the electrode flush with the discharge surface. The holder is secured in an aperture provided in a recess in the burner ring by orbital staking.

1 Claim, 1 Drawing Sheet

GASEOUS FUEL BURNER AND METHOD OF MAKING SAME

CROSS REFERENCE TO RELATED APPLICATION

This application is a Divisional application of application Ser. No. 08/282,359,Filed On Jul. 29, 1994 , U.S. Pat. No. 5,464,345 entitled 'GASEOUS FUEL BURNER AND METHOD 0F MAKING SAME' in the name of David J. Kwiatek.

BACKGROUND OF THE INVENTION

The present invention relates to ring-type or circular burners for burning gaseous fuel and particularly burners of the type employed in cooking appliances such as household range top burners. Range top burners are presently manufactured to employ a high voltage arc discharge device for igniting the fuel emanating from the burner ring. Where such spark igniters are employed, it has been found expedient to form the burner ring of conductive metal such that the arc can discharge from a high voltage electrode placed in close proximity to the fuel ports in the burner ring to effect ignition upon arc discharge to the metal ring.

In the present manufacture of cooking range top burners, the primary air-fuel mixture is supplied to the center of the burner ring through an aspirator tube which admixes the air and gaseous fuel prior to discharge through the passages in the burner ring; however, the primary air-fuel mixture is generally too fuel-rich to burn. Therefore a secondary supply of air is required and in so called "open" burners an annular air space is provided about the burner ring to provide additional external air mixing and burning.

In the so called "sealed" burners the range deck closely interfits the burner ring and thus provides a smaller region of the range top into which spill-over or boil-over can fall and accumulate in the burner well but generally requires higher fuel pressures and port velocities to entrain sufficient secondary air for burning. It is apparent that of the two types of burners mentioned above, the sealed burner is the easiest to maintain because the spillage and boil over falls on a flat surface rather than in a burner well.

Heretofore, range top burner rings have been manufactured by stamping and joining thin sheet metal such as stainless steel or by casting light metal such as aluminum. In either type of burner manufacturing, problems have been encountered in providing a simple and easily assembled yet sealed connection to the fuel supply tube in the range top; and, problems have also been encountered in providing for accurate and low cost mounting of the spark igniter about the periphery of the burner ring. It has also been desired to provide for improved secondary fuel-air mixing in the region of the igniter and particularly in the aforesaid sealed burner arrangements.

SUMMARY OF THE INVENTION

It is an object of the present invention to provide a simplified construction for a gaseous fuel burner of the type employing a spark igniter and to provide for improved connection and sealing the burner to a fuel supply;

It is a further object of the present invention to provide a cast light metal fuel burner having a frictionally engaged and sealed connection to the fuel supply tube;

It is a further object of the invention to provide a gaseous fuel burner having a spark igniter formed of a refractory holder with a hollow metal electrode received therein for providing secondary air flow to the region of the burner to be ignited;

It is a further object of the invention to provide a gaseous fuel burner having a spark igniter with a refractory holder defining a flat discharge surface with a hollow metal electrode having its end flush with the flat discharge surface;

It is a further object of the present invention to provide a integrally formed gaseous fuel burner having a spark igniter with a refractory holder having a hollow metal electrode therethrough with the holder retained on the burner by metal deformation of the burner.

The present invention utilizes a unitary cast aluminum burner having an enlarged flange at one end of a tubular portion with an annular recess in the face of the flange and communicating with a plurality of circumferentially spaced radially extending fuel passages. A burner cover plate is registered over the annular recess; and, a spark igniter having a hollow tubular refractory holder with a hollow metal electrode received therein is disposed in an aperture formed in a recess provided in the burner flange and retained in an aperture by deformation of the aluminum material of burner flange. A coil spring is received in the tubular portion or base of the burner and upon insertion of a supply tube therein a smaller diameter central coil of the spring frictionally engages the inserted supply tube; and, the spring is expanded such that the outer periphery of the end coils engage the inner periphery of the burner to seal and secure the supply tube therein.

DETAILED DESCRIPTION

Figure 1:
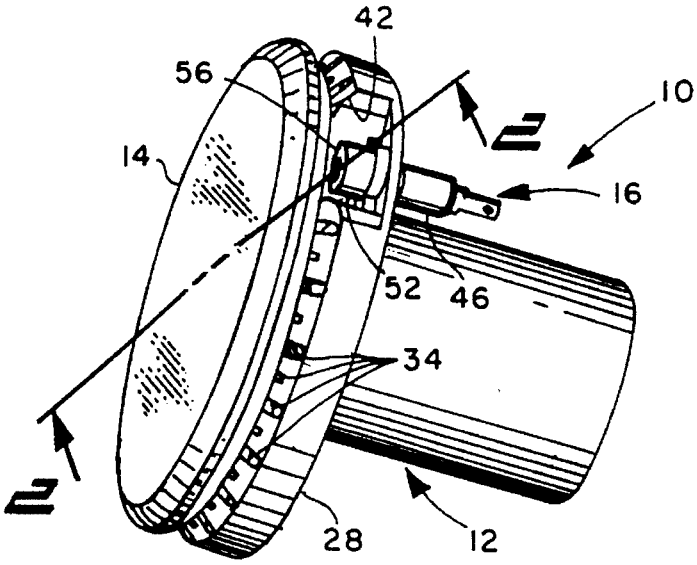
FIG. 1 is an axonometric projection of the burner assembly of the present invention.
Figure 2:
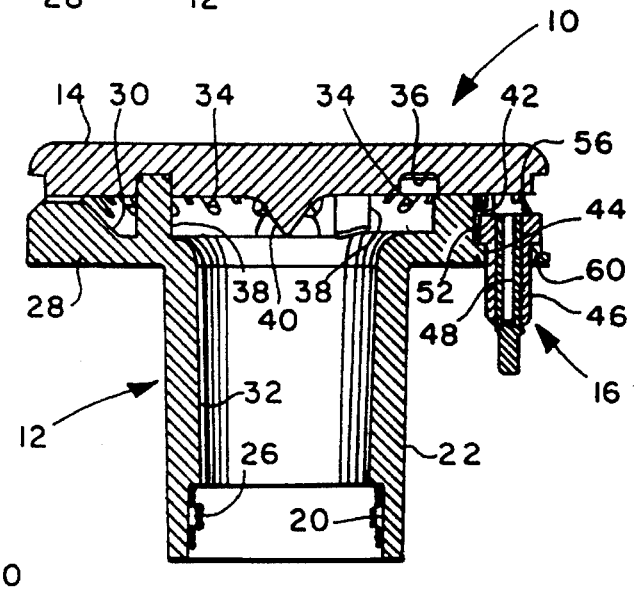
FIG. 2 is a section view taken along section indicating lines 2—2 of FIG. 1; and, FIG. 3 is an exploded view of the burner assembly of FIG. 1.
Figure 3:
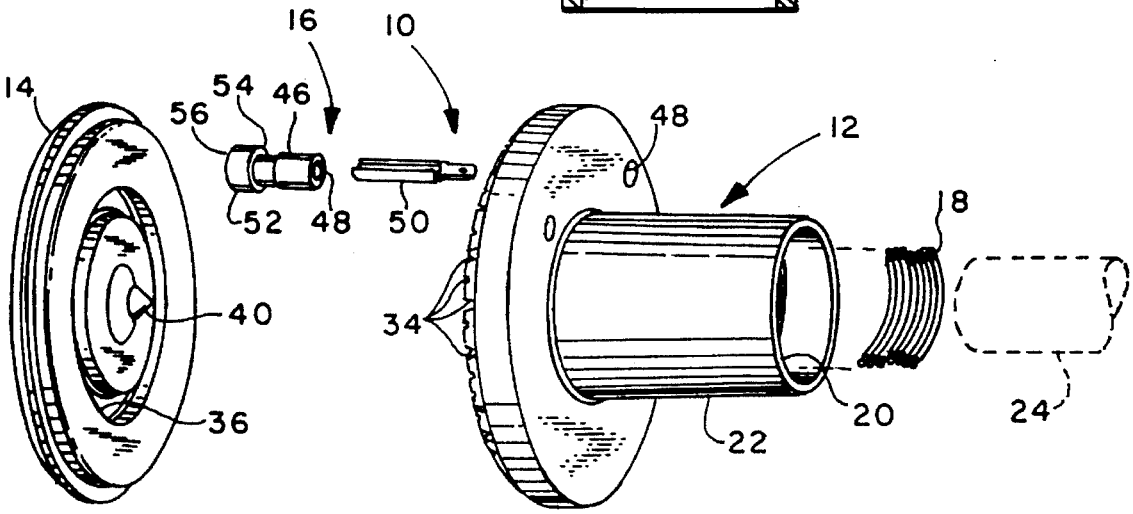

Referring to FIGS. 1–3 the burner assembly of the present invention is indicated generally at 10 and comprises a body indicated generally at 12 which in the presently preferred practice is integrally formed of aluminum preferably cast, with a cover plate 14, also preferably of aluminum, and an igniter subassembly indicated generally at 16. A supply tube connector 18 in the form of a coil spring is received in a controlled diameter counterbore or shoulder 20 provided in the end of the smaller diameter tubular portion 22 of the body 12. The connector 18 is adapted to have inserted therein and frictionally engaged therewith a fuel supply line tube 24 (indicated in dashed outline in FIG. 3). The spring 20 has at least one of its coils 26 preferably located intermediate the ends thereof reduced in diameter to be frictionally engaged and expanded by the tube 24. The expansion of spring 20 causes the outer periphery of the end coils of the spring to engage and seal against the bore 20; and, the reduced diameter coil 26 to be engaged and sealed about the outer periphery of the supply tube. Thus, the spring 18 provides a unique and relatively low-cost means for connecting and sealing the burner body to a gaseous fuel supply tube.

The burner body 12 has an enlarged diameter flange portion 28 which extends radially outwardly from the smaller diameter portion 22 at one end thereof, the flange 28 having the axial end face thereof provided with an annular recess 30 which communicates with the hollow interior 32 of the smaller diameter portion 22. The flange 28 also has a plurality of circumferentially spaced radially extending fuel passages 34 formed therein and preferably formed as grooves in the end face of the flange. Each of the fuel passages 34 preferably has the ratio of the length to the largest transverse dimension thereof at least 8:1 to provide sufficient velocity to produce the desired flame characteristics upon burning. The cover plate 14 has the underface thereof provided with an annular recess 36 which engages a plurality of registration pins 38 disposed about the axial end face of the flange 28. The cover plate 14 also preferably has a conically tapered diffuser 40 extending downwardly from the underface thereof for directing flow of the gaseous fuel outwardly to the passages 34.

Flange 28 has a recess or cavity 42 provided in the outer periphery thereof which has, when viewed from the top with the cover removed or from the end face of the flange 28, a generally arcuate configuration; and, in the presently preferred practice, the recess 42 subscribes an arc of 120°. The recess or cavity 42 surrounds an aperture 44 formed axially through the face or bottom of the recess which aperture has received therein the igniter 16.

Igniter 16 includes a holder 46 formed of any suitable refractory insulating material and has a generally tubular configuration with a central bore or passage 48 therethrough. A generally tubular hollow electrode 50 formed of a suitable electrically conductive material such as, for example, stainless steel, is received in flange aperture 44. The holder 46 has an enlarged diameter portion 52 provided at one end thereof which defines a shoulder or annular underface 54 and which has a generally flat axial end face 56. The tubular electrode is preferably formed as a roll pin and is pressed into the holder bore 48 and positioned therein with the end of the electrode 50 flush with the flat end face 56 of the holder. Electrode 50 has an integrally formed preferably stamped, connector terminal 58 provided on the end remote from holder face 56 which is adapted for external electrical connection thereto. The holder and electrode as a subassembly which comprise the igniter 26 are inserted into the aperture 48 in recess 42. The enlarged diameter portion 52 of the holder has its axial length from the shoulder 54 to the end face 56 chosen such that end face 56 is spaced from the undersurface of the cover plate 14 so as to define the desired air gap for electric arc discharge thereacross. In the presently preferred practice of the invention, the holder is retained in the aperture 48 by suitable staking on the under surface of flange 28 as, for example, by orbital staking indicated by reference numeral 60 in FIG. 2.

This flat surface 56 arrangement of the electrode and holder enables the arc to travel along the surface of the electrode holder and provide ignition of the fuel adjacent the flat surface even though the arc does not discharge to the cover plate of the burner assembly. It will be understood that the hollow electrode 50 provides an air passage to the region of the arc discharge face 56 of the igniter to provide sufficient secondary air at the point of the arc discharge to ensure ignition of the fuel emanating from the burner passages 34 in the region of the recess 42.

The present invention thus provides a unique integrally formed burner ring with an insert-type self sealing connector adapted for attachment of the burner to the fuel supply tube without the need for additional seals or mechanical fastening. The burner of the present invention provides a refractory igniter having a flat arc discharge surface with a hollow electrode therethrough having the end of the electrode flush with the arc discharge surface. Although the igniter is preferably retained in the burner by staking of the burner material about the aperture into which the igniter is received, other techniques may be employed, as, for example, a separate retaining clip.

Although the invention has hereinabove been described with respect to the illustrated embodiments, it will be understood that the invention is capable of modification and variation and is limited only by the following claims.

We claim:

1. An igniter for a gaseous fuel burner comprising: P1 (a) a hollow generally tubular holder formed of refractory material and having an enlarged diameter portion formed at one end thereof, said enlarged portion having a generally flat end face;

(b) a hollow electrode formed of electrically conductive material, said electrode comprising a roll-pin received in and frictionally engaging said hollow of said holder with an end of said electrode substantially coincident with said flat end face; and, (c) a connector terminal formed integrally with an end of said electrode distal said flat end face, wherein said hollow electrode is adapted to provide an air passage.

* * * * *